US006286602B1

(12) United States Patent
Lemetayer et al.

(10) Patent No.: US 6,286,602 B1
(45) Date of Patent: Sep. 11, 2001

(54) METHOD FOR CONTROLLING A DEVICE FOR TRANSPORTING HYDROCARBONS BETWEEN PRODUCTION MEANS AND A TREATMENT PLANT

(75) Inventors: Pierre Lemetayer, Pau; Jacques Poublan, Montardon, both of (FR)

(73) Assignee: Elf Exploration Production (FR)

( * ) Notice: Subject to any disclaimer, the term of this patent is extended or adjusted under 35 U.S.C. 154(b) by 0 days.

(21) Appl. No.: 09/398,464

(22) Filed: Sep. 17, 1999

(30) Foreign Application Priority Data

Sep. 21, 1998 (FR) ..... 98 11727

(51) Int. Cl.[7] ..... E21B 43/12

(52) U.S. Cl. ..... 166/311; 166/345; 166/370; 166/372; 166/375

(58) Field of Search ..... 166/344, 345, 166/310, 311, 313, 370, 372, 374, 375

(56) References Cited

U.S. PATENT DOCUMENTS 4,427,345 * 1/1984 Blann et al. .
4,901,798 * 2/1990 Amani .

FOREIGN PATENT DOCUMENTS 0 410 522 1/1991 (EP) ..... F16L/58/00
0 756 065 1/1997 (EP) ..... E21B/43/12
2 252 797 8/1992 (GB) ..... E21B/43/12
2 280 460 2/1995 (GB) ..... F17D/1/00

* cited by examiner

*Primary Examiner*—Roger Schoeppel
(74) *Attorney, Agent, or Firm*—Blank Rome Comisky & McCauley, LLP

(57) ABSTRACT

The invention relates to a method for controlling a device for transporting hydrocarbons in the form of a mixture of liquid and gas between production means (1) and a treatment plant (10).

The method according to the invention for controlling a device comprising a hydrocarbons transport pipe (6) fitted with an adjustable-aperture outlet choke (9) to which a gas-injection pipe (16) fitted with a control valve (15) is connected, is characterized in that it includes a start-up phase which consists in performing the following sequence of steps:

a step of initiating the transport of hydrocarbons, a step of ramping up to transport speed, then a production phase, during which phases the outlet choke (9) and the control valve (15) are operated in such a way as to maintain the stability of the pressure in the pipe (6) for transporting the hydrocarbons produced.

The invention finds an application in the operation of off-shore oil production installations.

10 Claims, 1 Drawing Sheet

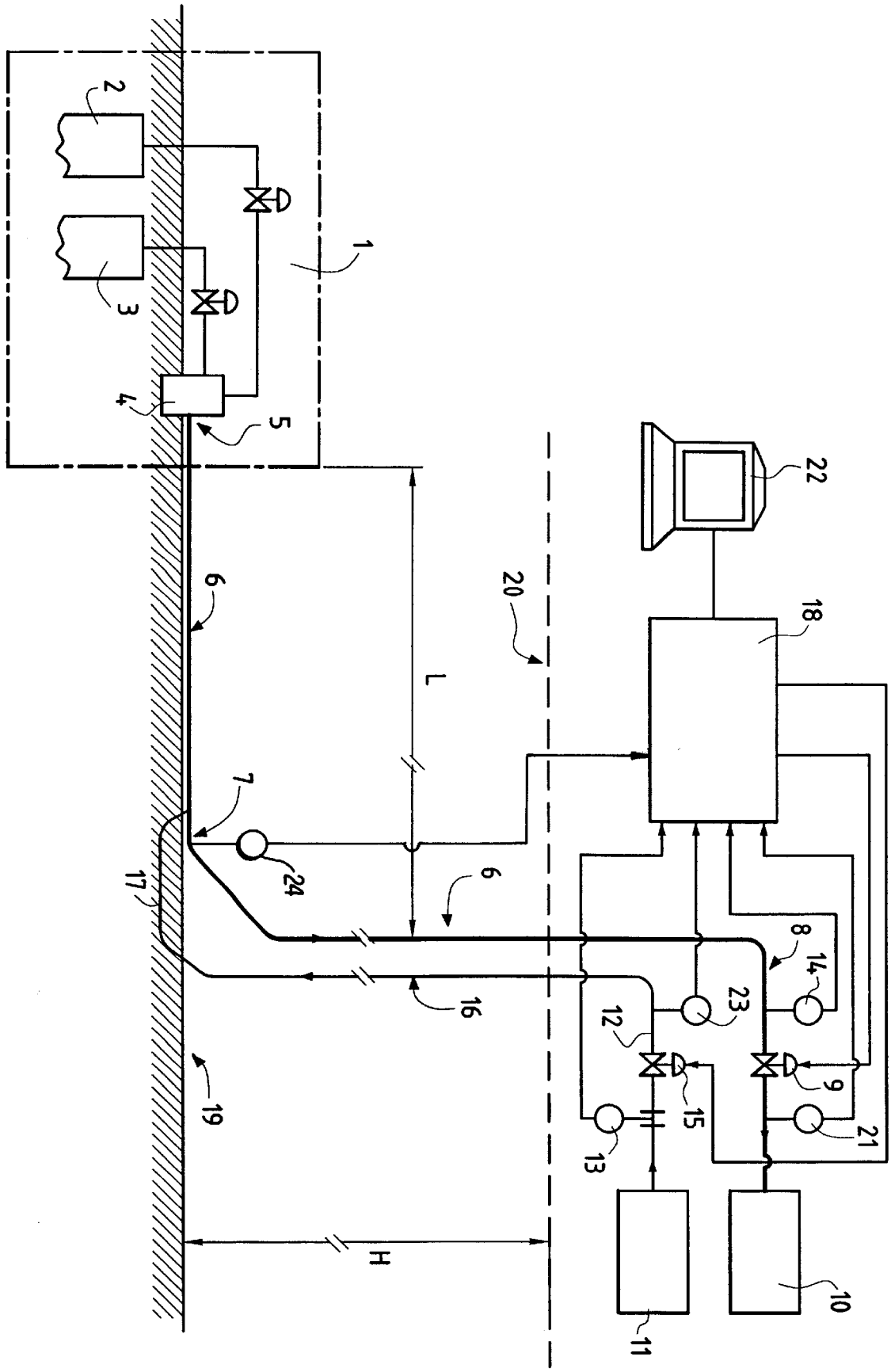
1
2
3
4
5
6
7
8
9
10
11
12
13
14
15
16
17
18
19
20
21
22
23
24
L
H

METHOD FOR CONTROLLING A DEVICE FOR TRANSPORTING HYDROCARBONS BETWEEN PRODUCTION MEANS AND A TREATMENT PLANT

TECHNICAL FIELD

The present invention relates to a method for controlling a device for transporting hydrocarbons, in the form of a mixture of liquid and gas, between off-shore hydrocarbons production means and a unit for processing the said hydrocarbons.

STATE OF THE PRIOR ART

A conventional technique used for exploiting subsea deposits of hydrocarbons consists in pooling the hydrocarbons produced in liquid and gaseous form by several neighbouring wells and transporting them to a processing plant mounted on a floating support or on a support of the platform type, above sea level.

For this purpose, the underwater wellheads with which the production wells are equipped are connected to a single transport pipe which runs along the seabed between the wellheads and the support leg of the treatment plant and then rises, via a riser system, to above sea level, where it is connected, usually through an outlet choke, to the treatment plant.

Under certain operating conditions, the mixture of liquid and gas in the transport pipe is in the form of an alternating series of plugs of liquid and pockets of gas which result in substantial fluctuations in the pressures and flowrates of the two fluids, which fluctuations are incompatible with correct operation of the treatment plant and also disrupt the flow of hydrocarbons in the wells.

One method which aims to avoid the development of plugs of liquid in such a hydrocarbons transport device is described in document EP 0,410,552 A 2 of 30.01.91.

As the outlet choke is used as a means of controlling the flows of gas and of liquid in a downstream section of the transport pipe, this method consists in:

- determining a flow of fluid, which is defined as the sum of the flows of gas and of liquid in the said section, and
- adjusting the flow-control means so as to minimize the variations in flow of fluids in the said section.

According to this method, the flows of fluid are defined as being the instantaneous volumetric flowrates of the fluids.

This method is not suited to the control of a hydrocarbons transport device which comprises, in addition to the transport pipe, means of injecting gas upstream of the rising section of the said pipe, which allow gas to be injected in order to lighten the mixture of liquid and gas produced so as to make it easier to raise to the surface, because, in this case, the measurement of the flow of gas produced is rendered inaccurate by the flowrate of injected gas.

Furthermore, this method does not allow the transport device to be started up gradually with a minimum of pressure and flowrate surges, nor does it allow the device to be controlled during disrupted particular operations such as the passage of a scraping device, nor does it, in all phases of operation, prevent the formation of plugs of gas in the transport pipe accompanied by plugs of liquid hydrocarbons.

Nor can it be used for producing hydrocarbons at low cost at an established rate, that is to say by injecting a minimum amount of gas for a given amount of hydrocarbons produced.

DESCRIPTION OF INVENTION

The present invention is intended precisely to overcome these drawbacks by proposing a method for controlling a device for transporting hydrocarbons between production means and a treatment plant which makes it possible to prevent the formation of plugs and ensure the stability of the flowrate of hydrocarbons in disrupted situations, thus creating conditions that are favourable to the optimum control of the treatment plant.

Furthermore, by virtue of the invention, a maximum amount of produced hydrocarbons can be transported at the best cost.

To this end, the invention proposes a method for controlling a device for transporting liquid and gaseous hydrocarbons between production means and a treatment plant, which device comprises a pipe, for transporting the hydrocarbons, which has a lower section connected to the hydrocarbon production means and an upper end connected to the treatment plant through an adjustable-aperture outlet choke, the said method being characterized in that the said device additionally comprises a gas-injection pipe which has an upstream end connected to a source of pressurized gas through a control valve and a downstream end connected to the lower section of the hydrocarbons transport pipe and in that, when the outlet choke and the control valve are closed, it includes a start-up phase which consists in performing the following sequence of steps:

- a step of initiating the transport of hydrocarbons which consists:
  - in comparing the pressure in the lower section of the hydrocarbons transport pipe with a predetermined threshold Pf1 and:
    - a) if this pressure is above the threshold Pf1, in gradually opening the outlet choke to a predetermined value to ensure that the hydrocarbons transported flow at a predetermined minimum flowrate, or
    - b) if this pressure is below the threshold Pf1, in injecting gas at a predetermined flowrate to encourage the hydrocarbons to flow through the transport pipe, and, when the difference between the pressures upstream and downstream of the outlet choke exceeds a predetermined threshold, in gradually opening the said choke (9) to a predetermined value to ensure that the hydrocarbons transported flow at a predetermined minimum flowrate,
  - in waiting for a predetermined length of time to allow the minimum hydrocarbon flowrate to become established;
- a step of ramping up to transport speed, which consists in periodically performing the following operations:
  - determining a pressure instability factor F in the lower section of the pipe, and comparing the instability factor F with two predetermined thresholds F1 and F2, F2 being higher than F1, and:
    - a) if the instability factor F is below F1 and if a target transported-hydrocarbons flowrate has not been achieved, opening the outlet choke wider by a predetermined amount,
    - b) if the instability factor F is below F1 and if a target transported-hydrocarbons flowrate has been achieved, decreasing the flowrate of injected gas by a predetermined amount,
    - c) if the instability factor F is between F1 and F2 and if the injected-gas flowrate is zero, injecting a predetermined flow of gas to fill the gas-injection pipe as far as its downstream end,
    - d) if the instability factor F is above F2, increasing the gas flowrate by a predetermined amount to ensure that there is a continuous flow of gas in the lower section of the pipe and so as to increase the pressure difference available across the outlet choke, repeating the above operations if at least one of the previous actions have been performed within a predetermined space of time.

According to another feature of the invention, the start-up phase is followed by a production phase which consists in ensuring production stability by performing the following monitoring operations:

determining at least one factor G which characterizes the start of an interruption in the circulation of the gaseous hydrocarbons in the lower section of the pipe, comparing the said factor G with a predetermined threshold and:

if it exceeds the threshold, increasing the gas flowrate to a predetermined value and reducing the aperture of the outlet choke to a predetermined value, otherwise, comparing the flowrate of the hydrocarbons produced with the target flowrate, and:

a) if it is below the target flowrate, increasing the flowrate of injected gas, b) if it is above the target flowrate, decreasing the flowrate of injected gas, if an action has been taken during the preceding monitoring operations, the production phase then consists in periodically performing the following stability-control operations:

determining a pressure instability factor S in the lower section of the pipe, and comparing the instability factor S with two predetermined thresholds S1 and S2, S2 being higher than S1, and:

a) if the instability factor S is below S1 and if a target transported-hydrocarbons flowrate has not been achieved, opening the outlet choke wider by a predetermined amount, b) if the instability factor S is below S1 and if a target transported-hydrocarbons flowrate has been achieved, decreasing the flowrate of injected gas by a predetermined amount, c) if the instability factor S is above S2, increasing the injected-gas flowrate by a predetermined amount to ensure that there is a continuous flow of gas in the lower section of the pipe and so as to increase the pressure difference available across the outlet choke, repeating the above operations if at least one of the previous actions have been performed within a predetermined space of time, resuming the previous monitoring operations.

According to another feature of the invention, the instability factor S is calculated from the difference between the pressure in the lower section of the pipe and the pressure upstream of the outlet choke.

According to another feature of the invention, the instability factor F is calculated from the pressure in the lower section of the pipe.

According to another feature of the invention, with the means of producing hydrocarbons comprising an outlet to which the lower section of the hydrocarbons transport pipe is connected, the instability factor F is calculated from the difference between the pressure in the lower section of the pipe and the pressure at the outlet from the hydrocarbons production means.

According to another feature of the invention, the factor G which characterizes the start of an interruption in the flow of gaseous hydrocarbons in the lower section of the pipe is calculated from the pressure in the lower section of the pipe.

According to another feature of the invention, with the hydrocarbons production means comprising an outlet to which the lower section of the hydrocarbons transport pipe is connected, the factor G which characterizes the start of an interruption in the flow of the gaseous hydrocarbons in the lower section of the pipe is calculated from the difference between the pressure in the lower section of the pipe and the pressure at outlet from the hydrocarbons production means.

According to another feature of the invention, the pressure in the lower section of the hydrocarbons transport pipe is measured using a sensor.

According to another feature of the invention, the method consists in:

preceding the step of initiating the transport of hydrocarbons with a preliminary step which consists in opening the valve which controls the flowrate of injected gas, so as to obtain an injected-gas flowrate Q1 for a predetermined length of time, permanently maintaining the injected-gas flowrate at a value at least equal to Q1, calculating the pressure in the lower section of the hydrocarbons transport pipe from the pressure downstream of the control valve and from the injected-gas flowrate.

BRIEF DESCRIPTION OF THE DRAWINGS

The invention will be better understood from reading the following description which is given by way of example, with reference to the appended drawings in which the single figure depicts a device for transporting hydrocarbons between subsea oil wells and a treatment plant, allowing the invention to be implemented.

DETAILED DESCRIPTION OF THE INVENTION

In general, the method of the invention is used to control a device for transporting hydrocarbons between means of producing the said hydrocarbons and a unit for processing them.

The single figure depicts an offshore installation for producing hydrocarbons in the form of a mixture of liquid and gas, which comprises:

production means 1 for producing from two wells 2 and 3, the production of which is combined in a manifold 4 which has an outlet 5 for the hydrocarbons produced, a unit 10 for processing the hydrocarbons produced, a source 11 of pressurized gas, a pipe 6 for transporting the hydrocarbons produced, with a lower section 7, and an upper end 8, equipped with an outlet choke 9, a gas-injection pipe 16, fitted with a control valve 15, which has an upstream end 12 and a downstream end 17, a sensor 13 for measuring the flowrate of injected gas and which delivers an electronic signal which represents this flowrate, a sensor 14 for measuring the pressure upstream of the choke 9, which delivers an electronic signal which represents this pressure, a sensor 23 for measuring the pressure downstream of the control valve 15, which delivers an electronic signal which represents this pressure, a sensor 24 for measuring the pressure in the lower section 7 of pipe 6, which delivers an electronic signal which represents this pressure, a programmable controller 18 with inputs which 30 receive the electronic signals delivered by the sensors 13, 14, 21, 23 and 24 and outputs which deliver signals for operating the outlet choke 9 and the control valve 15, means 22 for dialogue between operator and controller 18.

The pipe 6 for transporting the hydrocarbons produced connects the outlet 5 of the hydrocarbons production means to the treatment plant 10 through the outlet choke 9 placed at the upper end 8 of the pipe 6.

The pipe 6 runs along the seabed 19 for a distance L, the depth of water being H; the treatment plant 10 and the source 11 of pressurized gas, the valve 15, the choke 9 and the controller 18 are located above sea level 20.

The controller 18 additionally comprises, and this is not depicted in the single figure, a memory which has been loaded beforehand with a control program and with the data needed to control the hydrocarbons transport device, particularly with all the predetermined values of the adjustment variables. This data is entered in advance by an operator using operator/controller dialogue means 22 and can be updated by the same means during production.

Some of this data may be entered by a control-assistance computer, not depicted in the single figure.

The controller 18 automatically controls the flowrate of injected gas measured by means of the sensor 13, to keep it at a set point value which is determined according to the control program and the values of the adjustment variables and as a function of the signals delivered by the sensors 14, 21 and 23, by acting on the control valve 15.

Before the hydrocarbons transfer device is put into operation, the outlet choke 9 and the control valve 15 are closed.

The method of the invention comprises a phase of starting up the transport device, during which phase the controller 18 opens the control valve 15 to inject a flowrate Q1 of gas for an experimentally-determined length of time so that the pipe 16 no longer contains liquid hydrocarbons. The value of Q1 is determined as a function of the characteristics of the installation and may be set, for example, at 1% of the maximum gas-injection flowrate for which the installation has been designed so that pressure drops due to friction are negligible.

On the basis of the value of the pressure Pa downstream of the control valve 15, measured by the sensor 23, the controller 18 calculates the pressure Pf in the lower section 7 of the pipe 6, using the following formula:

$$Pf=Pa(1+K)$$

in which K is a constant such that K·Pa represents the weight of a column of gas of unit cross section, of height H under the thermodynamic conditions in the pipe 16.

The injected-gas flowrate will be kept at a value at least equal to Q1 throughout the following operations.

The start-up phase then comprises a step of initiating the transport of hydrocarbons, during which step the controller 18 performs the following operations:

it compares the pressure Pf with a threshold Pf1 which has been predetermined as a function of the height H of water column and of the physical characteristics of the hydrocarbons transported so that the exceeding of this threshold signifies that there is sufficient pressure margin to allow production to start without the need to supply external energy, if this pressure Pf is higher than Pf1, then the controller 18 issues a command to gradually open the outlet choke 9 to a predetermined value to ensure that the hydrocarbons flow at a minimum flowrate Qm set experimentally, for example, to be between 20 and 50% of the maximum flowrate for which the transport device was designed, if this pressure Pf is lower than Pf1, this means that the pressure Pf is not high enough to give the outlet choke 9 sufficient control margin, and in such a case the controller 18 issues a command to increase the injected-gas flowrate to a flowrate Qd which is predetermined by calculation, to encourage the transported hydrocarbons to flow.

When the difference between the pressures upstream and downstream of the choke 9, measured by the sensors 14 and 21, respectively, exceeds a threshold that has been predetermined by calculation, the controller 18 issues a command to gradually open the choke 9 to a predetermined value so that the hydrocarbons transported achieve the minimum flowrate Qm.

The controller 18 waits for a length of time that has been predetermined by calculating the time required for a sweep through the pipe 6, to ensure that the minimum flowrate Qm for transported hydrocarbons becomes established.

The start-up phase then comprises a step of ramping up to transport speed, during which step the controller 18 determines an instability factor F for the pressure Pf in the lower section 7 of the pipe 6, using the following formula:

$$F=(Pfmax-Pfmin)/Pfmean$$

in which:

Pfmax represents the maximum value of the pressure Pf over a sliding 5-minute period, Pfmin represents the minimum value of the pressure Pf over a sliding 5-minute period, Pfmean represents the temporal mean value of the pressure Pf over a sliding 5-minute period.

The controller 18 compares F with two thresholds F1 and F2 which have been predetermined by calculating characteristic fluctuations of an acceptably stable flow, F2 being higher than F1.

If F is lower than F1, which is equal, for example, to 50%, and if the flowrate of transported hydrocarbons, estimated from the aperture of the choke 9 and from the difference in pressures measured by the sensors 14 and 21, is lower than a target production flowrate set by an operator, the controller 18 increases the aperture of the outlet choke 9 by a predetermined amount, for example 2% of the maximum aperture.

If F is lower than F1 and if the transported-hydrocarbons target flowrate is achieved, then the controller 18 reduces the injected-gas flowrate by reducing the value of the set point to which the said flowrate is slaved.

If F is higher than F2, which is equal, for example, to 75%, the controller 18 issues a command to increase the injected-gas flowrate to a value Qd so as:

to ensure a flow of gas injected into the lower section 7 of the pipe 6, to increase the pressure difference available across the outlet choke 9 in order to maintain a margin for controlling the flowrate, to prevent the formation of a plug of liquid by continuous and forced injection of gas to ensure that there is a liquid-gas mixture present in the rising part of the pipe 6, even if there is no gas in the hydrocarbons entering the section 7, and to allow the well to continue to produce.

If one of the previous four actions have been performed during a minimum stabilization period, the length of which is predetermined by calculation and is for example 60 minutes, the operations in the step of ramping up the transport speed are repeated.

These actions are thus repeated periodically according to the value of F with respect to the thresholds.

If it has not been possible to satisfy any of the conditions which initiate an action during the minimum stabilization period, then the start-up phase is complete.

As the start-up phase is complete, the transported-hydrocarbons flowrate is equal to the target flowrate. According to the invention, this start-up phase is followed by a production phase during which the controller 18 monitors the stability of production by performing the following operations:

It determines a factor G which characterizes the start of an interruption in the flow of gaseous hydrocarbons in the lower section 7 of the pipe 6, by applying the following formula:

$$G=[(Pfmax2-Pfmin2)(Pfmean2-Pfmean30)]/[(Pfmax30-Pfmin30)\cdot Pfmean30]$$

In which:

Pfmean2, Pfmax2 and Pfmin2 respectively represent the sliding mean, the maximum value and the minimum value, over the last two minutes, of the pressure in the lower section of the transport pipe, Pfmean30, Pfmax30 and Pfmin30 respectively represent the sliding mean, the maximum value and the minimum value, over the last 30 minutes, of the pressure in the lower section of the transport pipe.

The controller 18 compares the calculated value of factor G with a predetermined start-of-stabilization threshold SD.

If this value G exceeds the predetermined threshold SD, which is equal, for example, to 50%, the controller 18 issues a command to increase the injected-gas flowrate to a value which is predetermined by calculation and equal, for example, to 90% of the flowrate for which the installation was designed, and issues a command to close the outlet choke 9 as far as a value which has been predetermined by calculation.

If G does not exceed the threshold SD, the controller 18 compares the flowrate of produced hydrocarbons, estimated from the pressures upstream and downstream of the choke 9 and from the hydraulic characteristics of the said choke, with the target flowrate.

If the produced-hydrocarbons flowrate is lower than the target flowrate then the controller 18 issues a command to increase the injected-gas flowrate by a predetermined increment, for example 5% of the maximum value of the injected-gas flowrate for which the transport device was designed.

If the produced-hydrocarbons flowrate is higher than the target objective, then the controller 18 issues a command to reduce the injected-gas flowrate by a predetermined decrement, for example 5% of the maximum value of the injected-gas flowrate for which the transport device was designed.

If, during the previous monitoring operations, an action has been needed, the controller 18 determines a factor S representative of the instability of the pressure in the lower section 7 of the pipe 6, for example the ratio between the effective weight of the column of fluid in the rising part of the pipe 6 and the theoretical weight of this column. This ratio is calculated using the following formula:

$$S=\frac{Pfmean5-Pupstream-K\lambda}{Pr\,m}\times\frac{Pr\,m+Kz(Kg+Qg/Qp)}{Kd+Kz(Kg+Qg/Qp)}$$

In which:

Pfmean5 represents the sliding mean, over the last 5 minutes, of the pressure in the lower section of the transport pipe, Pupstream5 represents the sliding mean, over the last 5 minutes, of the pressure upstream of the choke 9, Kλ is a constant to take account of the frictional pressure drop in the rising part of the pipe 6, Kz is the constant relating to the compressibility of the gas and to its weight, Kg is a constant relating to the amount of gas associated with the liquids produced, Kd is a constant relating to the density of the liquids produced, Qg is the sliding mean, over the last 5 minutes, of the injected-gas flowrate, Qp is the sliding mean, over the last 5 minutes, of the flowrate of liquid hydrocarbons transported, Prm is the mean pressure in the rising part of the pipe 6, calculated using the formula Prm=(Pfmean5+Pupstream5)×½.

The flowrate Qg is measured using the sensor 13 and Qp is estimated from the pressures upstream and downstream of the choke 9 and from the hydraulic characteristics of the said choke.

Furthermore, S=200 if the instantaneous pressure Pf in the lower section 17 of the pipe 6 increases by more than 10% during the sliding 5-minute period and S=0% if the instantaneous pressure Pf in the lower section 17 of the pipe 6 decreases by more than 10% during the sliding 5-minute period.

If the factor S which reflects the instability in the pressure in the lower section of the pipe 6 is below the predetermined threshold S1, which is equal, for example, to 90%, and if the transported-hydrocarbons target flowrate is achieved, then the controller 18 issues a command to reduce the gas flowrate by a predetermined amount, for example 5% of the maximum value of the hydrocarbons flowrate for which the transport device was designed.

If the factor S which reflects the instability in the pressure in the lower section of the pipe 6 is above a predetermined threshold S2, which is equal, for example, to 150%, then the controller 18 issues a command to increase the injected-gas flowrate by a predetermined amount equal, for example, to 20% of the maximum flowrate for which the installation was designed, to ensure that there will be a continuous flow of gas in the lower section of the pipe 6 and to increase the pressure difference available across the outlet choke.

If at least one of the actions resulting from the previous stability control exercise has been performed within a predetermined length of time equal, for example, to 60 minutes, the controller 18 repeats the previous stability control operations.

If not, the controller 18 resumes the previous monitoring operations.

By virtue of the method of the invention, for a given target production of hydrocarbons, the amount of gas injected is minimal and the stability of the flows and of the pressure in the lower section 7 of the pipe 6 is ensured.

What is claimed is:

1. Method for controlling a device for transporting liquid and gaseous hydrocarbons between production means and a treatment plant, which device comprises a pipe, for transporting the hydrocarbons, which has a lower section connected to the hydrocarbon production means and an upper end connected to the treatment plant through an adjustable-aperture outlet choke, a gas-injection pipe which has an upstream end connected to a source of pressurized gas through a control valve and a downstream end connected to the lower section of the hydrocarbons transport pipe and when the outlet choke and the control valve are closed, said method includes a start-up phase which comprises performing the following sequence of steps:

initiating the transport of hydrocarbons which comprises:

comparing the pressure in the lower section of the hydrocarbons transport pipe with a predetermined threshold Pf1 and:

a) if this pressure is above the threshold Pf1, gradually opening the outlet choke to a predetermined value to ensure that the hydrocarbons transported flow at a predetermined minimum flowrate, or b) if this pressure is below the threshold Pf1, injecting gas at a predetermined flowrate to encourage the hydrocarbons to flow through the transport pipe, and, when the difference between the pressures upstream and downstream of the outlet choke exceeds a predetermined threshold, gradually opening the said choke to a predetermined value to ensure that the hydrocarbons transported flow at a predetermined minimum flowrate, waiting for a predetermined length of time to allow the minimum hydrocarbon flowrate to become established;

ramping up to transport speed, which comprises periodically performing the following operations:

determining an instability factor F for the pressure in the lower section of the pipe, and comparing the instability factor F with two predetermined thresholds F1 and F2, F2 being higher than F1, and:

a) if the instability factor F is below F1 and if a target transported-hydrocarbons flowrate has not been achieved, opening the outlet choke wider by a predetermined amount, b) if the instability factor F is below F1 and if a target transported-hydrocarbons flowrate has been achieved, decreasing the flowrate of injected gas by a predetermined amount, c) if the instability factor F is between F1 and F2 and if the injected-gas flowrate is zero, injecting a predetermined flow of gas to fill the gas-injection pipe as far as its downstream end, d) if the instability factor F is above F2, increasing the gas flowrate by a predetermined amount to ensure that there is a continuous flow of gas in the lower section of the pipe and so as to increase the pressure difference available across the outlet choke, repeating the above operations if at least one of the previous actions have been performed within a predetermined space of time.

2. Control method according to claim 1, wherein the start-up phase is followed by a production phase which comprises ensuring production stability by performing the following monitoring operations:

determining at least one factor G which characterizes the start of an interruption in the circulation of the gaseous hydrocarbons in the lower section of the pipe, comparing the said factor G with a predetermined threshold, and:

if it exceeds the threshold, increasing the gas flowrate to a predetermined value and reducing the aperture of the outlet choke to a predetermined value, otherwise, comparing the flowrate of the hydrocarbons produced with the target flowrate, and:

a) if it is below the target flowrate, increasing the flowrate of injected gas, b) if it is above the target flowrate, decreasing the flowrate of injected gas, if, an action has been taken during the preceding monitoring operations, the production phase then comprises periodically performing the following stability-control operations:

determining an instability factor S for the pressure in the lower section of the pipe, and comparing the instability factor S with two predetermined thresholds S1 and S2, S2 being higher than S1, and:

a) if the instability factor S is below S1 and if a target transported-hydrocarbons flowrate has not been achieved, opening the outlet choke wider by a predetermined amount, b) if the instability factor S is below S1 and if a target transported-hydrocarbons flowrate has been achieved, decreasing the flowrate of injected gas by a predetermined amount, c) if the instability factor S is above S2, increasing the injected-gas flowrate by a predetermined amount to ensure that there is a lower section of the pipe and so as to increase the pressure difference available across the outlet choke, repeating the above operations if at least one of the previous actions have been performed within a predetermined space of time, resuming the previous monitoring operations.

3. Control method according to claim 2, wherein the instability factor S is calculated from the difference between the pressure in the lower section of the pipe and the pressure upstream of the outlet choke.

4. Control method according to claim 1, wherein the instability factor F is calculated from the pressure in the lower section of the pipe.

5. Control method according to claim 1, wherein with the means for producing hydrocarbons comprising an outlet to which the lower section of the hydrocarbons transport pipe is connected, the instability factor F is calculated from the difference between the pressure in the lower section of the pipe and the pressure at the outlet from the hydrocarbons production means.

6. Control method according to claim 2, wherein the factor G which characterizes the start of an interruption in the flow of gaseous hydrocarbons in the lower section of the pipe is calculated from the pressure in the lower section of the pipe.

7. Control method according to claim 2, wherein with the hydrocarbons production means comprising an outlet to which the lower section of the hydrocarbons transport pipe is connected, the factor F which characterizes the start of an interruption in the flow of the gaseous hydrocarbons in the lower section of the pipe is calculated from the difference between the pressure in the lower section of the pipe and the pressure at outlet from the hydrocarbons production means.

8. Control method according to claim 1, wherein the pressure in the lower section of the hydrocarbons transport pipe is measured using a sensor.

9. Control method according to claim 1, further comprising:

preceding the step of initiating the transport of hydrocarbons with a preliminary step which comprises opening the valve which controls the flowrate of injected gas, so as to obtain an injected-gas flowrate Q1 for a predetermined length of time, permanently maintaining the injected-gas flowrate at a value at least equal to Q1, calculating the pressure in the lower section of the hydrocarbons transport pipe from the pressure downstream of the control valve and from the injected-gas flowrate.

10. Control method according to claim 9, wherein the calculated value of the pressure in the lower section of the pipe is used as the pressure which is compared with the predetermined pressure threshold Pf1.

* * * * *